United States Patent [19]

Weissman

[11] 4,246,727

[45] Jan. 27, 1981

[54] FIXTURE FOR USE IN GRINDING AND POLISHING TABLE FACETS OF GEMS

[75] Inventor: Ilan Weissman, Herzelia, Israel

[73] Assignee: Hargem Limited, Ramat Gan, Israel

[21] Appl. No.: 7,477

[22] Filed: Jan. 26, 1979

[51] Int. Cl.[3] ..... B24B 9/16

[52] U.S. Cl. ..... 51/121; 51/229

[58] Field of Search ..... 125/30 B; 51/229, 121, 51/125

[56] References Cited

U.S. PATENT DOCUMENTS

| | | | |
|---|---|---|---|
| 1,461,149 | 7/1923 | Hunt | 51/229 |
| 3,811,230 | 5/1974 | Beck | 51/229 |

*Primary Examiner*—Harold D. Whitehead

*Attorney, Agent, or Firm*—Benjamin J. Barish

[57] ABSTRACT

A fixture is described for aiding the grinding and polishing of a facetted gem, the fixture to be pivotably mounted to a vertical stand at one side of a rotary-driven grinding and polishing disc. The fixture comprises upper and lower supporting arms to overlie the disc, an upper alignment head supported at the end of the upper supporting arm for engagement with the upper end of the holder stick carrying the gem, and a lower alignment head supported at the end of the lower supporting arm for engagement with the lower end of the holder stick, to thereby position and hold the holder stick and the gem at a right angle to the disc as the fixture is swung on the stand to sweep the gem across the face of the disc.

8 Claims, 4 Drawing Figures

FIXTURE FOR USE IN GRINDING AND POLISHING TABLE FACETS OF GEMS

BACKGROUND OF THE INVENTION

The present invention relates to a fixture for use in grinding and polishing table facets of gems.

Diamonds are usually polished by mounting same to a holder (sometimes called a "dop") which is pressed against a rotary-driven polishing disc. Less expensive facetted gems are usually polished by manually holding the gem against the polishing disc or, in the case of small gems, by mounting the gem to the end of a holder which is held against the polishing disc.

SUMMARY OF THE INVENTION

The present invention is directed to a fixture for use in grinding and polishing the table facets of gems carried at the ends of holder sticks.

More particularly, the present invention provides a fixture to be pivotably mounted to a vertical stand at one side of a rotary-driven grinding and polishing disc for aiding the grinding and polishing of a facetted gem carried at the end of a holder stick. Briefly, the fixture comprises upper and lower supporting arms to overlie the disc when the fixture is so mounted, an upper alignment head supported at the end of the upper supporting arm open at one side of the fixture to define a positioning face face engageable only with one side of the upper end of the holder stick, and a lower alignment head supported at the end of the lower supporting arm open at the opposite side of the fixture to define a positioning face engageable only with the opposite side of the lower end of the holder stick, to thereby permit manual positioning and holding of the holder stick and the facetted gem carried by it at a right angle to the disc as the fixture is manually swung on the stand to sweep the gem across the face of the disc. At least one of the alignment heads is adjustable to permit it to be preset to align the holder stick to the right angle.

According to further features included in the described preferred embodiment, the sides of the upper and lower alignment heads engaging the holder stick are each formed with a recessed face receiving the holder stick. Preferably, the upper alignment head is adjustable towards and away from the stand, and the lower alignment head is fixed so that its side for engagement with the holder stick is exactly at a right angle to the upper surface of the grinding and polishing disc.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

With reference to the drawings, there is shown a base 2 on which is rotatably mounted a grinding and polishing disc 4 having a central spindle 6, the disc being rotated by a drive motor (not shown). A vertical stand

Figure 4:
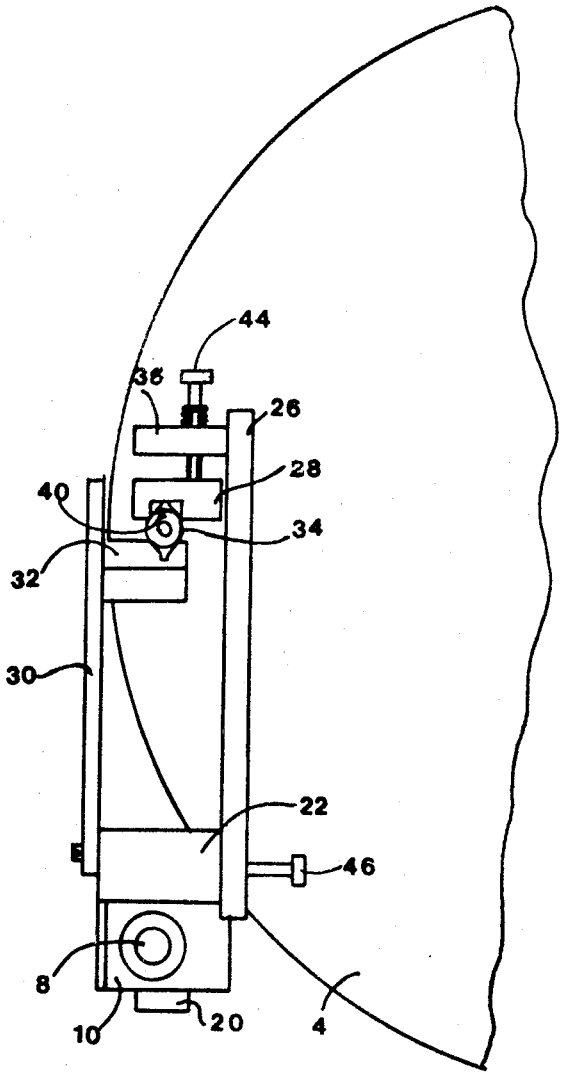
FIG. 4 is a top plan view of the fixture of FIG. 1.

8 is secured to base 2 at one side of the disc 4. The fixture of the present invention is to be mounted on stand 8 to enable the fixture to be pivotted along the vertical axis of the stand so as to overlie the disc 4, as shown particularly in FIG. 4.

The fixture includes a bar 10 having a cylindrical bore for pivotably mounting same on the vertical stand 8. A lower bearing ring 12 secured to stand 8 by a screw 14, and an upper bearing ring 16 secured to stand 8 by a screw 18, engage the opposite sides of the mounting bar 10 and thereby fix its vertical position. The mounting bar 10 is pivotable in this vertical position to stand 8, but may be fixed in this vertical position by means of a screw 20 passing through the bar into engagement with stand 8.

A vertical carrier member 22 is pivotably mounted at its lower end, by means of a pin 24, to the mounting bar 10. Carrier member 22 includes an upper supporting arm 26 carrying at its end an upper alignment head 28, and a lower supporting arm 30 carrying at its end a lower alignment head 32. A holder stick (shown in broken lines at 34) carrying the facetted gem 36 at its lower end, is adapted to be manually held against the upper and lower alignment heads 28 and 32, respectively, for precisely positioning and holding the gem 36 on the grinding and polishing disc 4. When the gem table facet is to be formed or polished, the holder 34 is held by the two alingment heads 28, 32, precisely at a right angle to the upper surface of the grinding and polishing disc 4.

Figure 1:
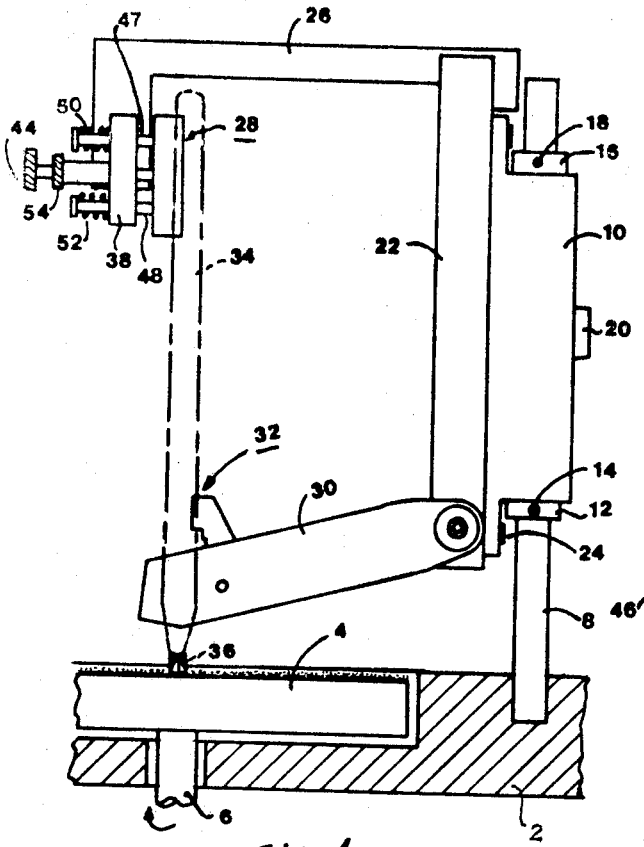
FIG. 1 is a side elevational view of a preferred form of fixture constructed in accordance with the invention.

It will be seen particularly from FIG. 1 that the upper alignment head 28 is open at one side of the fixture (right side in FIG. 1) to define a positioning face engageable only with one side of the upper end of the holder stick 34, and the lower alignment head 32 is open at the opposite side of the fixture (left-side in FIG. 1) to define a positioning face engageable with only the opposite side of the lower end of the holder stick. This arrangement facilitates the manual positioning of the holder stick 34, and the facetted gem 36 is carried at its lower end, at a right angle to the disc 4 as the fixture is manually swung along the vertical axis of stand 8 to sweep the gem across the face of the disc.

Figure 2:
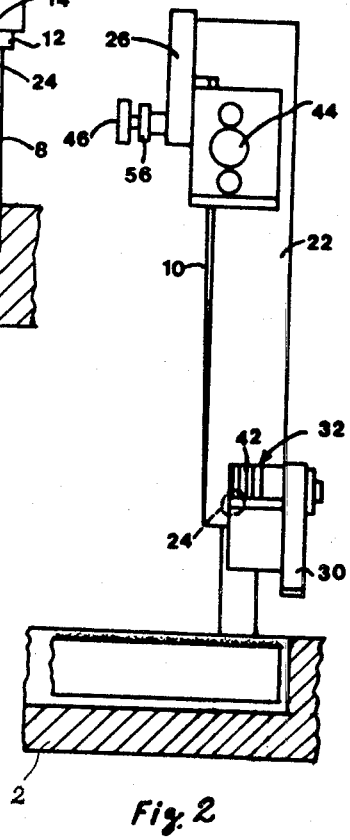
FIGS. 2 and 3 are end elevational views of the two opposite ends of the fixture of FIG. 1.
Figure 3:
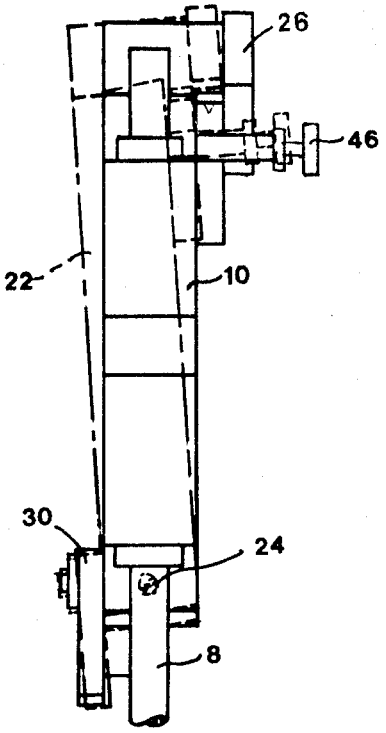

More particularly, the upper alignment head 28 is carried by a vertical leg 38 depending from the end of the upper supporting arm 26. Its side facing stand 8 is recessed, as shown at 40 in FIG. 4, for receiving the upper end of the holder stick 34. The lower alignment head 32 is formed with a similar recess 42 (FIG. 2), but in this case the recess faces in the opposite direction, namely away from stand 8, so as to receive the opposite side of the lower end of holder stick 34.

The fixture provides two axes of adjustment of the alignment heads 28, 32. One axis of adjustment enables the upper alignment head 28 to be moved towards and away from stand 8 by turning an adjustment screw 44. The second axis of adjustment enables the complete carrier member 22, including both of the alignment heads 28, 32, to be moved about pivot pin 24 by turning an adustment screw 46, this axis of adjustment being thereby substantially in the horizontal direction at right angles to the first axis of adjustment of the upper alignment head 28.

More particularly, adjustment screw 44 is threaded through vertical leg 38, and the end of the adjustment screw is flattened within a bore formed in head 28 so as to permit the screw 44 to rotate within head 28 and at the same time to advance and retract same with respect to leg 38 as the screw is rotated within that leg. A pair of guide rods 47, 48 are fixed to alignment head 28 on opposite sides of adjustment screw 44 and pass through bores formed in leg 38 to guide the movement of the alignment head 28 during the rotation of adjustment screw 44. Springs 50, 52 are interposed between the leg 38 and the enlarged head at the tips of the guide rods 47, 48 to take up any backlash in the adjustment. The position of adjustment screw 44 may be fixed by lock-nut 54.

For adjusting the carrier member 22 about horizontal pivot 24, adjusting screw 46 is threadedly received within arm 26 of the carrier member 22 and its end engages bar 10 such as to permit the screw to rotate with respect to the bar, but to cause the carrier member to pivot about pivot 24 on bar 10. This portion of the carrier member may be fixed by lock-nut 56 on adjustment screw 46.

In use, mounting bar 10 is received on vertical stand 8 at the desired height as fixed by bearing rings 12 and 16. The holder 34 carrying the facetted gem 36 at its end is then manually placed and held by the operator against the lower alignment head 32 and the upper alignment head 28, as shown in FIG. 1, and the latter head is adjusted by screw 44 until it is felt that the flat table of the gem 36 is in firm contact on its complete surface with the grinding and polishing disc 4; this would be when the holder stick 34 is precisely at a right angle to the disc 4. A similar adjustment may be made by rotating adjusting screw 46 to pivot the carrier member 22 about pivot 24, until it is felt that the holder stick is precisely at a right angle to the disc 4 in the plane of that adjustment.

After the fixture is so set, the holder stick 34 may be swung back and forth with the fixture along the vertical axis of stand 8 to cause the flat table of the gem 36, at the lower end of the holder stick, to sweep along the disc and thereby to be ground or polished by it. Once the fixture is so set, it can be used with other holder sticks for polishing other gems and usually does not require resetting.

While the invention has been described with respect to one preferred embodiment, it will be appreciated that many variations, modifications and other applications may be made.

What is claimed is:

1. A fixture to be pivotably mounted to a vertical stand at one side of a rotary-driven grinding and polishing disc for aiding the grinding and polishing of a facetted gem carried at the end of a holder stick, the fixture comprising: upper and lower supporting arms to overlie the disc when the fixture is so mounted; an upper alignment head supported at the end of the supporting arm open at one side of the fixture to define a positioning face engageable only with one side of the upper end of the holder stick; and a lower alignment head supported at the end of the lower supporting arm open at the opposite side of the fixture to define a positioning face engageable only with the opposite side of the holder stick, to thereby permit manual positioning and holding of the holder stick and the facetted gem carried by it at a right angle to the disc as the fixture is manually swung on the stand to sweep the gem across the face of the disc; at least one of said alignment heads being adjustable to permit same to be preset to align the holder stick to the right angle.

2. A fixture according to claim 1, wherein the sides of the upper and lower alignment heads engaging the holder stick are each formed with a recessed face receiving the holder stick.

3. A fixture according to claim 1, wherein said upper alignment head is adjustable towards and away from the stand, and the lower alignment head is fixed so that its side for engagement with the holder stick is exactly at a right angle to the upper surface of the grinding and polishing disc.

4. A fixture according to claim 3, wherein said upper alignment head is carried by a vertical leg depending from the end of the upper supporting arm and includes adjusting means for adjusting same towards and away from said stand.

5. A fixture according to claim 4, wherein said adjusting means includes an adjusting screw threaded into said vertical leg into engagement with the upper alignment head.

6. A fixture according to claim 5, wherein said adjusting means further includes a pair of guide rods disposed on opposite sides of the adjusting screw and guiding the horizontal movement of the upper alignment head with respect to said vertical leg.

7. A fixture according to claim 6, further includes a spring interposed between the upper alignment head and said vertical leg.

8. A fixture according to claim 1, further including a bar having a vertical bore therethrough for pivotably mounting same on the vertical stand, said upper and lower supporting arms being carried by a carrier member pivotably mounted to said bar along a horizontal axis passing through the lower end of the carrier member, there being an adjusting screw for pivoting said carrier member with respect to said bar.

* * * * *